US009930926B2

(12) United States Patent
Martinez et al.

(10) Patent No.: US 9,930,926 B2
(45) Date of Patent: Apr. 3, 2018

(54) CONTOURED SUPPORT INSOLE

(75) Inventors: Jacob Martinez, Temple, TX (US); David B. Granger, Lorena, TX (US); Paul Lewis, Beeton (CA)

(73) Assignee: Implus Footcare, LLC, Durham, NC (US)

( * ) Notice: Subject to any disclaimer, the term of this patent is extended or adjusted under 35 U.S.C. 154(b) by 862 days.

(21) Appl. No.: 13/640,712

(22) PCT Filed: Jun. 23, 2011

(86) PCT No.: PCT/US2011/041667

§ 371 (c)(1),
(2), (4) Date: Oct. 11, 2012

(87) PCT Pub. No.: WO2011/163501

PCT Pub. Date: Dec. 29, 2011

(65) Prior Publication Data

US 2013/0025156 A1 Jan. 31, 2013

Related U.S. Application Data

(60) Provisional application No. 61/358,723, filed on Jun. 25, 2010.

(51) Int. Cl.
*A43B 7/14* (2006.01)
*A43B 17/02* (2006.01)
(Continued)

(52) U.S. Cl.
CPC ..... *A43B 7/141* (2013.01); *A43B 7/142* (2013.01); *A43B 7/143* (2013.01); *A43B 7/144* (2013.01);
(Continued)

(58) Field of Classification Search
CPC ..... A43B 7/144; A43B 7/142; A43B 13/38
(Continued)

(56) References Cited

U.S. PATENT DOCUMENTS 333,595 A 1/1886 Butterfield
360,127 A 3/1887 Wallis
(Continued)

FOREIGN PATENT DOCUMENTS

CN 101282664 4/2011
DE 2603716 12/1976
(Continued)

OTHER PUBLICATIONS

[online] [retrieved on Jan. 22, 2013] [retrieved from Foot Science Limited website] (pdf) http://www.footscience.com/products_foot.html.
[online] [retrieved on Jan. 22, 2013] [retrieved from geldoctor website] (pdf) http://www.geldoctor.com/flosole.html.
[online] [retrieved on Jan. 22, 2013] [retrieved from Gerbing's website] (pdf) http://www.gerbing.com/Products/insoles.php.
[online] [retrieved on Jan. 22, 2013] [retrieved from Heat Factory website] (pdf) http://www.heatractory.com/english/product.pht?cat=3&id.
(Continued)

*Primary Examiner* — Megan Lynch
(74) *Attorney, Agent, or Firm* — Hemingway & Hansen, LLP; D. Scott Hemingway

(57) ABSTRACT

A contoured insole especially advantageous for users with medium to high arches is disclosed. It comprises a generally foot-shaped base extending from a heel end to a toe end, which comprises a top surface and a bottom surface. The bottom surface of the base preferably further comprises two indentations formed integrally therein in a forefoot area and a heel area. A forefoot pad and a heel pad are secured to each of said indentations. Preferably, the base is made from a polyurethane foam. The pads are made from rubber or synthetic rubber. A top sheet is coextensive with and secured to the top surface of the base. The top sheet is generally a fabric which preferably has antimicrobial characteristics. In use, the foot of the wearer, with or without a sock or stocking
(Continued)

thereon, rests upon the top sheet in the foot-receiving compartment of a user's shoe.

23 Claims, 6 Drawing Sheets

(51) Int. Cl.
*A43B 17/00* (2006.01)
*A43B 17/14* (2006.01)

(52) U.S. Cl.
CPC ..... *A43B 7/148* (2013.01); *A43B 7/1425* (2013.01); *A43B 7/1445* (2013.01); *A43B 17/006* (2013.01); *A43B 17/02* (2013.01); *A43B 17/14* (2013.01)

(58) Field of Classification Search
USPC ..... 36/44, 43
See application file for complete search history.

(56) References Cited

U.S. PATENT DOCUMENTS 892,360 A 6/1908 Burns
1,559,324 A 10/1925 Jensen
1,687,916 A * 10/1928 Wolf ..... 36/181
1,693,122 A 11/1928 Schwartz
1,718,906 A 6/1929 Hurley
1,811,641 A 6/1931 Marcelle
1,861,969 A 6/1932 Leighton, Jr.
1,920,112 A 7/1933 Shaft
1,934,591 A * 11/1933 Churchill et al. ..... 36/154
1,945,780 A 2/1934 Johnson
2,031,510 A 2/1936 Stewart et al.
2,045,844 A 6/1936 Everston
2,055,574 A 9/1936 Hartl
2,090,881 A 8/1937 Wilson
2,139,971 A * 12/1938 Pava ..... 36/141
2,207,437 A 7/1940 Marks et al.
2,224,590 A 12/1940 Boivin
2,224,642 A 12/1940 Burns
2,284,947 A 6/1942 Clifford
2,347,207 A 4/1944 Margolin
2,408,564 A 10/1946 Lea
D149,889 S 6/1948 Laybolt
2,502,774 A 4/1950 Alianiello
2,553,616 A 5/1951 Walls
2,713,732 A * 7/1955 Guest ..... 36/167
2,790,254 A 4/1957 Burns
2,827,050 A 3/1958 Fisher
2,857,689 A 10/1958 Van Ostrom et al.
2,985,971 A 5/1961 Murawski
3,084,695 A * 4/1963 O'Donnell ..... 36/174
3,154,867 A 11/1964 Strope
3,475,836 A * 11/1969 Brahm ..... 36/3 R
3,992,801 A 11/1976 McDiarmid et al.
D243,642 S 3/1977 Voorhees
4,020,570 A 5/1977 Shames
4,033,054 A 7/1977 Fukuoka
D246,486 S 11/1977 Nickel
4,071,963 A 2/1978 Fukuoka
4,108,928 A 8/1978 Swan, Jr.
4,123,855 A 11/1978 Thedford
4,139,337 A 2/1979 David et al.
4,150,455 A 4/1979 Fukuoka
4,179,826 A 12/1979 Davidson
4,215,492 A 8/1980 Sandmeier
4,219,945 A 9/1980 Rudy
4,223,457 A 9/1980 Borgeas
4,229,546 A 10/1980 Swan, Jr.
4,237,626 A 12/1980 Brown
4,263,728 A 4/1981 Frecentese
4,309,831 A 1/1982 Pritt
4,316,332 A 2/1982 Giese et al.
4,325,380 A 4/1982 Malkin
4,346,205 A 8/1982 Hiles
4,346,525 A 8/1982 Larsen et al.
4,364,188 A 12/1982 Turner et al.
4,408,402 A 10/1983 Looney
4,413,429 A 11/1983 Power
4,453,322 A 6/1984 Marsh
1,541,186 A 9/1985 Mulvihill
4,541,184 A 9/1985 Leighton
4,546,555 A 10/1985 Spademan
4,557,060 A 12/1985 Kawashma
4,581,187 A 4/1986 Sullivan et al.
4,584,782 A 4/1986 Thatcher
4,616,430 A 10/1986 McQuiggin
4,619,056 A 10/1986 Lin et al.
4,627,178 A 12/1986 Sullivan et al.
4,627,179 A 12/1986 McElroy
4,633,597 A 1/1987 Shiang
4,633,598 A 1/1987 Moronaga et al.
4,633,877 A 1/1987 Pendergast
D288,383 S 2/1987 Autry
4,674,204 A 6/1987 Sullivan et al.
4,694,589 A 9/1987 Sullivan et al.
4,694,831 A 9/1987 Seltzer
4,729,179 A 3/1988 Quist, Jr.
D295,690 S 5/1988 Finn
D299,583 S 1/1989 Tong et al.
4,800,657 A 1/1989 Brown
4,813,160 A 3/1989 Kuznetz
4,860,463 A 8/1989 Pin
4,864,736 A 9/1989 Bierk
4,864,740 A 9/1989 Oakley
4,876,758 A 10/1989 Rolloff et al.
4,887,368 A 12/1989 Latzke
4,888,841 A 12/1989 Cumberland
4,888,887 A 12/1989 Solow
4,928,404 A 5/1990 Scheuermann
D311,269 S 10/1990 Graham et al.
4,974,342 A 12/1990 Nakamura
5,010,661 A 4/1991 Chu
5,014,706 A 5/1991 Philipp
5,025,573 A 6/1991 Giese et al.
5,025,575 A 6/1991 Lakic
5,027,461 A 7/1991 Cumberland
5,035,068 A 7/1991 Biasi
D319,919 S 9/1991 Niarhos
D324,761 S 3/1992 Soo-Kwan
5,092,060 A 3/1992 Frachey et al.
5,138,775 A 4/1992 Chu
5,155,927 A 10/1992 Bates et al.
5,184,409 A 2/1993 Brown
5,197,207 A 3/1993 Shorten
5,201,125 A 4/1993 Shorten
D336,718 S 6/1993 Schroer, Jr.
5,224,277 A 7/1993 Sang Do
5,233,767 A 8/1993 Kramer
D342,374 S 12/1993 Wand
5,282,324 A 2/1994 Cheng
D346,480 S 5/1994 Davidson
D348,146 S 6/1994 Nakano
D349,393 S 8/1994 Mishan
D350,432 S 9/1994 Saez
D350,848 S 9/1994 Tzenos
5,367,791 A 11/1994 Gross et al.
D353,710 S 12/1994 Brazzell
5,369,896 A 12/1994 Frachey et al.
5,375,346 A 12/1994 Cole et al.
5,400,528 A 3/1995 Skinner et al.
5,400,526 A 4/1995 Sessa
5,408,761 A 4/1995 Gazzano
5,430,960 A 7/1995 Richardson
5,438,768 A 8/1995 Bauerfeind
5,443,529 A 8/1995 Phillips
5,467,536 A 11/1995 Ramer et al.
5,493,791 A 2/1996 Kramer
D367,953 S 3/1996 King
5,509,938 A 4/1996 Phillips
5,524,364 A 6/1996 Cole et al.
5,545,463 A 8/1996 Schmidt et al.
D374,549 S 10/1996 McDonald

(56) References Cited

U.S. PATENT DOCUMENTS 5,615,496 A 4/1997 Sharpstein
5,619,809 A 4/1997 Sessa
5,640,779 A 6/1997 Rolloff et al.
D380,290 S 7/1997 Nakagawa
D383,894 S 9/1997 Snyder et al.
5,669,162 A * 9/1997 Dyer ..... 36/44
D384,797 S 10/1997 Nakagawa
5,675,914 A 10/1997 Cintron
5,678,328 A 10/1997 Schmidt et al.
5,685,094 A 11/1997 Lin
D388,947 S 1/1998 Sessa
D389,296 S 1/1998 Sessa
D389,996 S * 2/1998 Sessa ..... D2/961
5,714,098 A 2/1998 Potter
5,722,186 A 3/1998 Brown
5,732,481 A 3/1998 Farhad
5,771,606 A 6/1998 Litchfield et al.
5,775,005 A 7/1998 McClelland
D396,948 S 8/1998 Moore et al.
5,802,737 A 9/1998 Beppu
D399,042 S 10/1998 Strawser et al.
5,846,063 A 12/1998 Lakic
5,852,885 A 12/1998 Ferniani
D403,847 S 1/1999 Blythe
5,879,725 A 3/1999 Potter
D411,759 S 7/1999 Byrd
D418,666 S 1/2000 Brown
D420,210 S 2/2000 Allen
D420,788 S 2/2000 Kitagawa
6,029,372 A 2/2000 Pan
D423,765 S 5/2000 Autry
D425,690 S 5/2000 Bray et al.
D426,118 S 6/2000 Thomas
6,070,342 A 6/2000 Brown
6,079,123 A 6/2000 Clark
D428,689 S 8/2000 Guiotto et al.
D429,063 S 8/2000 Rose
6,105,283 A 8/2000 Park
D432,769 S 10/2000 Yung et al.
6,151,801 A 11/2000 Frederiksen et al.
6,176,025 B1 1/2001 Patterson et al.
6,192,607 B1 * 2/2001 Kolada et al. ..... 36/145
D441,947 S 5/2001 Escobar et al.
6,233,847 B1 * 5/2001 Brown ..... 36/44
D448,542 S 10/2001 Bryant
6,301,805 B1 * 10/2001 Howlett et al. ..... 36/43
D456,128 S 4/2002 Evans et al.
6,408,543 B1 * 6/2002 Erickson et al. ..... 36/100
D460,854 S 7/2002 Hung
6,425,195 B1 7/2002 Donzis
6,453,578 B1 * 9/2002 Yung et al. ..... 36/43
D465,079 S 11/2002 Merceron
D465,844 S 11/2002 Anderson et al.
6,481,120 B1 * 11/2002 Xia et al. ..... 36/44
6,497,057 B1 12/2002 Lee et al.
6,502,330 B1 1/2003 David et al.
6,510,626 B1 1/2003 Greenawalt
6,519,874 B1 2/2003 Dean
D471,001 S 3/2003 Beck
6,553,690 B2 4/2003 Di Girolamo
D474,331 S 5/2003 Dean
D474,588 S 5/2003 Dean
D474,881 S 5/2003 Su
6,581,303 B1 6/2003 Tuan
6,598,319 B2 7/2003 Hardt
6,618,960 B2 9/2003 Brown
6,631,568 B2 10/2003 Howlett et al.
D485,425 S 1/2004 Polifroni
D485,426 S 1/2004 Di Girolamo
6,671,979 B2 1/2004 Cardarelli
6,684,532 B2 2/2004 Greene et al.
D489,520 S 5/2004 Matis et al.
D495,123 S 8/2004 Wakatake
D497,473 S 10/2004 Martinez
D497,708 S 11/2004 Granger et al.
D500,914 S 1/2005 Ammon
6,880,266 B2 * 4/2005 Schoenborn et al. ..... 36/28
6,915,598 B2 * 7/2005 Grisoni et al. ..... 36/151
6,959,505 B2 11/2005 Poe
6,967,044 B1 11/2005 O'Brien
6,976,322 B1 * 12/2005 Walker ..... 36/43
7,082,702 B2 8/2006 Cretinon
7,107,705 B2 9/2006 Dalton et al.
D529,691 S 10/2006 Earle
D543,685 S 6/2007 Andersen et al.
7,284,342 B2 10/2007 Avent et al.
7,316,081 B1 1/2008 Cheng
D563,649 S 3/2008 Andersen et al.
D576,391 S 9/2008 Contreras
D576,394 S 9/2008 Heller
7,437,836 B2 10/2008 Kim
D584,885 S 1/2009 Contreras
7,484,319 B2 2/2009 Cheskin et al.
D592,386 S 5/2009 Baker et al.
D593,742 S 6/2009 Issler
D594,640 S 6/2009 McMillan
D596,833 S 7/2009 Dominguez et al.
7,555,849 B2 * 7/2009 Canvin ..... 36/43
7,665,169 B2 2/2010 Cheskin et al.
7,712,229 B2 5/2010 Yang
D617,086 S 6/2010 Avent et al.
D617,087 S 6/2010 Avent et al.
D634,924 S 3/2011 Cheskin et al.
7,900,380 B2 3/2011 Rich
7,908,768 B2 3/2011 Cheskin et al.
8,042,287 B2 * 10/2011 Reinhardt et al. ..... 36/43
D656,716 S 4/2012 Eades
8,186,081 B2 5/2012 Wilson, III et al.
8,241,450 B2 8/2012 Hensley et al.
8,745,894 B2 * 6/2014 Cheskin et al. ..... 36/44
2001/0000369 A1 4/2001 Snyder et al.
2001/0039746 A1 * 11/2001 Seiter ..... 36/44
2002/0050080 A1 * 5/2002 Vasyli ..... 36/145
2002/0092203 A1 7/2002 Hardt
2002/0116840 A1 8/2002 Kraft
2003/0009915 A1 1/2003 Bacon
2003/0024134 A1 2/2003 Howlett et al.
2003/0070321 A1 4/2003 Davis et al.
2003/0093920 A1 5/2003 Greene et al.
2003/0121180 A1 7/2003 Poe
2003/0140524 A1 * 7/2003 Robinson et al. ..... 36/44
2003/0150134 A1 8/2003 Hardt
2004/0025374 A1 2/2004 Basso
2004/0118017 A1 * 6/2004 Dalton et al. ..... 36/44
2004/0181971 A1 * 9/2004 Turkbas et al. ..... 36/44
2004/0194344 A1 * 10/2004 Tadin ..... 36/44
2005/0138847 A1 6/2005 Blackburn et al.
2005/0166425 A1 * 8/2005 Seiter ..... 36/44
2005/0262736 A1 * 12/2005 Peoples ..... 36/44
2006/0016099 A1 1/2006 Marco et al.
2006/0026779 A1 2/2006 Berg et al.
2006/0086004 A1 * 4/2006 Davis et al. ..... 36/43
2006/0096124 A1 5/2006 Moseley
2006/0123664 A1 6/2006 Boyd et al.
2006/0130367 A1 6/2006 Liu
2006/0168846 A1 8/2006 Juan
2006/0230643 A1 10/2006 Affleck
2006/0254088 A1 10/2006 McCormick
2007/0022630 A1 * 2/2007 Lundy et al. ..... 36/28
2007/0033834 A1 * 2/2007 Cheskin et al. ..... 36/44
2007/0039209 A1 2/2007 White
2007/0107261 A1 * 5/2007 Cheskin et al. ..... 36/44
2007/0245592 A1 10/2007 Yamaguchi et al.
2007/0261268 A1 11/2007 Nguyen
2008/0028637 A1 2/2008 Benfatti
2008/0110060 A1 5/2008 Ritter
2008/0271340 A1 * 11/2008 Grisoni et al. ..... 36/43
2008/0313927 A1 * 12/2008 Conforti et al. ..... 36/91
2009/0025254 A1 * 1/2009 Smith ..... 36/44
2009/0049712 A1 * 2/2009 Steszyn et al. ..... 36/91
2009/0100722 A1 4/2009 Hoffer et al.
2009/0151194 A1 6/2009 Cheskin et al.
2009/0193683 A1 * 8/2009 Igdari ..... 36/91
2009/0199429 A1 * 8/2009 Ellis ..... 36/29

(56) References Cited

U.S. PATENT DOCUMENTS

| | | | | |
|---|---|---|---|---|
| 2009/0249650 | A1 | 10/2009 | Sarantakos | |
| 2010/0015869 | A1 | 1/2010 | Hartmann et al. | |
| 2010/0058540 | A1* | 3/2010 | Calvert | 5/652 |
| 2010/0083534 | A1 | 4/2010 | Howlett | |
| 2010/0095552 | A1 | 4/2010 | Cheskin et al. | |
| 2010/0126044 | A1 | 5/2010 | Davis | |
| 2010/0170116 | A1 | 7/2010 | Shim | |
| 2010/0205831 | A1 | 8/2010 | Cheskin et al. | |
| 2010/0218398 | A1* | 9/2010 | Reinhardt et al. | 36/44 |
| 2010/0251577 | A1 | 10/2010 | Yamada | |
| 2010/0275469 | A1* | 11/2010 | Ahlbaumer | 36/3 B |
| 2011/0072685 | A1* | 3/2011 | Gutowsky et al. | 36/44 |
| 2011/0131835 | A1* | 6/2011 | Cheskin et al. | 36/44 |
| 2011/0209360 | A1* | 9/2011 | Baker et al. | 36/44 |
| 2011/0219642 | A1* | 9/2011 | Sulak et al. | 36/44 |
| 2011/0232129 | A1 | 9/2011 | Roberts et al. | |
| 2011/0252671 | A1 | 10/2011 | Maron et al. | |
| 2011/0277354 | A1* | 11/2011 | Howlett et al. | 36/140 |
| 2011/0302805 | A1* | 12/2011 | Vito | 36/44 |
| 2013/0160331 | A1 | 6/2013 | Burke | |

FOREIGN PATENT DOCUMENTS

| | | | |
|---|---|---|---|
| EP | 0774219 | | 12/1997 |
| JP | 10-295409 | | 11/1998 |
| JP | 2003-38207 | | 2/2003 |
| JP | 2005-245471 | | 9/2005 |
| JP | 3142602 | | 6/2008 |
| KR | 20-0427687 | | 4/2006 |
| KR | 10-0641278 | B1 | 11/2006 |
| KR | 10-0736813 | | 7/2007 |
| KR | 10-0780086 | | 11/2007 |
| WO | 2004-060095 | A1 | 7/2004 |
| WO | WO 2006035469 | | 4/2006 |
| WO | WO 2006090398 | | 8/2006 |
| WO | WO 2007021328 | | 2/2007 |
| WO | WO 2007056101 | | 5/2007 |
| WO | 2008151595 | | 12/2008 |
| WO | 2009-126111 | A1 | 10/2009 |

OTHER PUBLICATIONS

[online] [retrieved on Jan. 22, 2013] [retrieved from Dr. Rosenberg's Foot Products website] (pdf) http://www.instantarches.com/cool-soles.shtml.

[online] [retrieved on Jan. 22, 2013] [retrieved from Mean and Green website]web page] (pdf) http://www.meanandgreen.com/army/-Thermal-Foil_insoles/2660/2303.html.

[online] [retrieved on Jan. 22, 2013] [retrieved from Superfeet website] (pef) http://www.superfeet.com/products/REDHot.aspx.

[online] [retrieved on Jan. 22, 2013] [retrieved from Thermo Soles website] (pdf) http://www.thermosoles.com/.

[online] [retrieved on Jan. 22, 2014] [retreived from Warmers.com website] (pdf) http://www.warmers.com/grabber-got-warmers-medium-5-hour-10pr-bundle.

PCT, International Search Report & Written Opinion of the International Searching Authority for PCT/US2013/026932. dated Jun. 18, 2013.

PCT, International Search Report & Written Opinion of the International Searching Authority for Counterpart International Patent Application No. PCT/US2006/014681. dated Mar. 13, 2007.

PCT, International Search Report & Written Opinon of the International Searching Authority for Counterpart International Pataent Application No. PCT/US2006/014681. dated Jul. 27, 2006.

PCT, International Search Report & Written Opinion of the International Searching Authority for Counterpart International Pataent Application No. PCT/US2006/014681. dated Nov. 12, 2013.

PCT, International Search Report & Written Opinion of the International Searching Authority for Counterpart International Patent Application No. US2014/055133, dated Jan. 15, 2015.

PCT, International Search Report & Written Opinion of the International Searching Authority for Counterpart International Patent Application No. US2006/014681, dated Jul. 27, 2006.

PCT, International Search Report & Written Opinion of the International Searching Authority for Counterpart International Patent Application No. US2013/057141, dated Nov. 12, 2013.

* cited by examiner

CONTOURED SUPPORT INSOLE

CROSS REFERENCE TO RELATED APPLICATIONS

This application claims the benefit of U.S. Provisional Patent Application Ser. No. 61/358,723 filed Jun. 25, 2010.

STATEMENT REGARDING FEDERALLY SPONSORED RESEARCH OR DEVELOPMENT

Not applicable.

TECHNICAL FIELD

This invention relates to the field of replacement insoles for shoes.

BACKGROUND OF THE INVENTION

Insoles are inserted in the shoes of a user to provide one or more advantages to to the comfort of the wearer or the support of the foot. Insoles are generally sold in pairs and one of each pair is adapted for use in a right shoe and the other adapted for use in a left shoe of a user. It is advantageous to provide appropriate structure to an insole so that it serves the purposes of the user.

DETAILED DESCRIPTION

Figure 1:
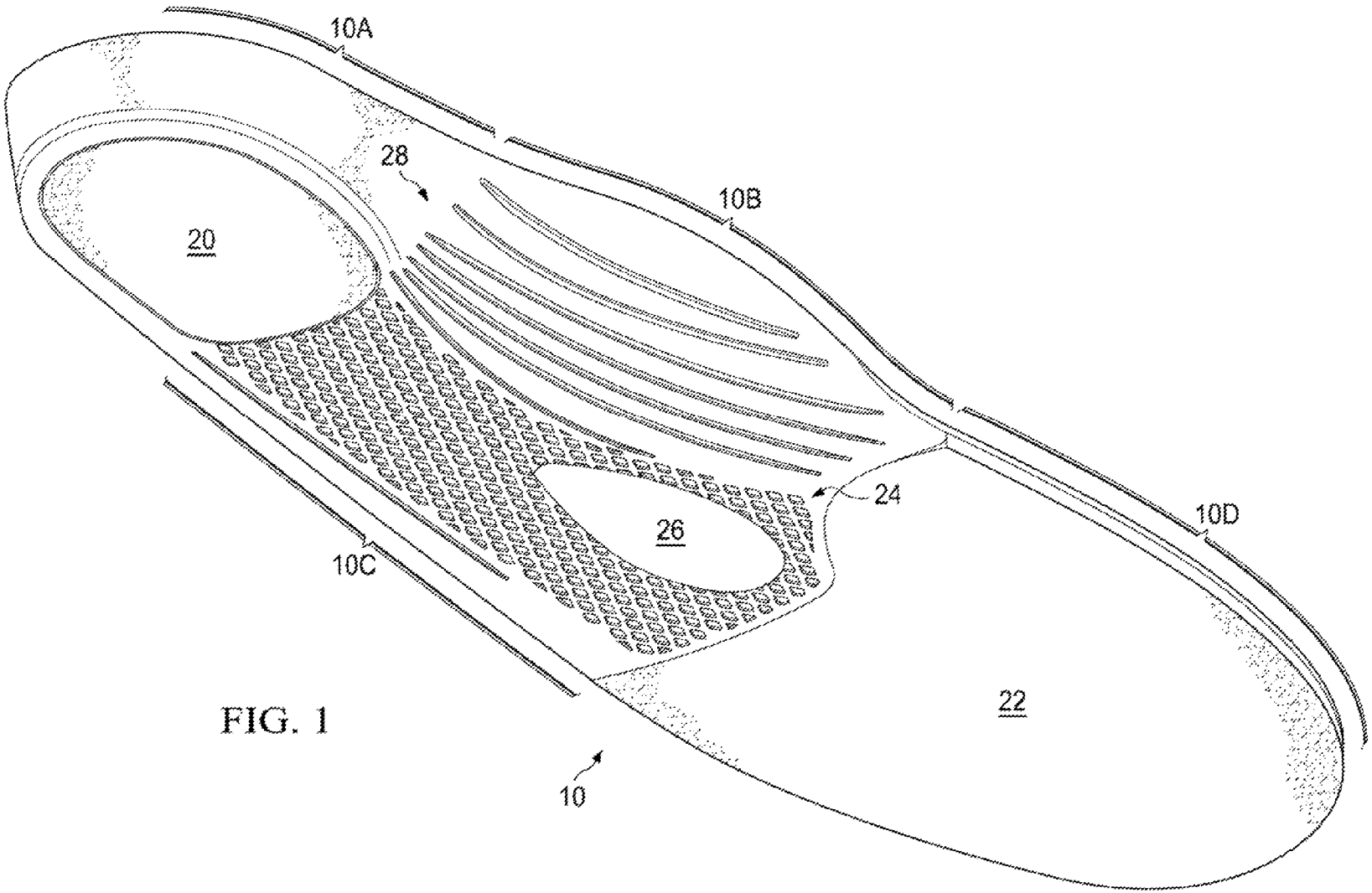
FIG. 1 is a perspective bottom view of a left insole according to the invention.

An insole advantageous for users having a medium to high arch is herein disclosed that provides arch and heel support to users in need of such support. The insole has a bottom (shoe side) and a top (foot side) and comprises a base having a contoured shape which receives and supports the foot of the user. The insole is intended to be used inside a shoe and the bottom side thereof will contact the interior of a shoe after insertion therein. In many cases, the insole will be used to replace an insole in the shoe.

The insole base has a heel end, a toe end, a lateral side and a medial side, said sides extending from said heel end to said toe end. The lateral side lies adjacent the outer side of a user's foot in use and the medial side lies adjacent the inner side of a user's foot in use, including the arch of the foot. Accordingly, the contoured shape includes an integrally formed raised arch support which extends generally upwardly on the medial side of the insole. This upward extension allows the raised arch support to lie adjacent to a user's foot arch during wearing.

The base has a base top surface and a base bottom surface. The base defines a heel area adjacent said heel end, a contoured arch support area adjacent said medial side, a midfoot area adjacent said contoured arch support area extending essentially horizontally from said contoured arch support area to said lateral side, a forefoot area adjacent said contoured arch support area and said midfoot area, and extending vertically to said toe end.

The base is preferably made from a lightweight resilient material which is capable of being molded into the desired shape and which provides the desired support and cushioning. A preferred material is polyurethane foam. Preferably, a polyurethane foam ("PU") having a hardness of 40 Asker C+/−3 and a density of about 0.41 g/ml +/−3 is employed. PU is preferred for the base material as it adapts to providing the insole with a deep heel cup which adheres to a top sheet intended to be worn next to the foot of the user.

PU is able to adhere to top cloth material and avoid separation of the top sheet from the base material.

The heel area of the base bottom surface preferably defines a heel cushion indentation for receiving a heel cushion, and in such case a heel cushion is disposed therein.

A preferred heel cushion is made from a neoprene or synthetic rubber layer which is a polymer of polychloroprene.

The forefoot area of the base bottom surface preferably defines a forefoot indentation for receiving a forefoot cushion and in such case a forefoot cushion is disposed therein.

A preferred forefoot cushion is made from a neoprene or synthetic rubber layer which is a polymer of polychloroprene.

The midfoot area of the base preferably defines a resilient area comprising an indentation which extends upwardly from said base bottom surface to said base top surface. From the vantage point of the base top surface, said resilient area is convex and from the vantage point of the base bottom surface, said resilient area is concave. The resilient area functions as a metatarsal pad to distribute pressure from the ball of a user's foot and assist in relieving forefoot pain. In use, the central part of the plantar fascia or the plantar aponeurosis of a user's foot rests on said resilient area.

In a preferred embodiment, said resilient area is molded into said base during manufacture. The convex structure lies under the foot during use and provides cushioning and support.

The insole preferably further comprises a top sheet having a top sheet bottom surface secured to said base top surface and a top sheet upper surface which contacts the foot of a user during use. Preferably, the top sheet is made of a low-friction fabric which prevents blisters on the user's foot. The top sheet may also contain an antimicrobial treatment in order to keep bacteria from multiplying and therefore reduce odor. A suitable treatment is Silpure® antimicrobial treatment (Thomson Research Associates, Inc., Ontario, CA.)

The base bottom arch area preferably defines a plurality of curvilinear indentations positioned from adjacent said midfoot area to said medial side. Lengthwise, said curvilinear indentations extend from approximately a border between said forefoot area and said arch/midfoot area to a border between said heel area and said arch/midfoot area.

The curvilinear indentations are preferably molded into the base during manufacture. They function to promote polyurethane material flow in the area of the midfoot while assisting to minimize voids caused by air entrapment. The curvilinear indentations in the arch area also allow the arch area to collapse to fit the shoe thus providing a more accommodative design.

Insole production can be accomplished by an open-pour molding process. The process consists of pouring mixed polyurethane into an open mold. Once poured in the mold, the polyurethane mixture will expand to fill the cavity. Once cured, the base insole is removed from the mold. The forefoot cushion and heel cushion if employed can be secured to the indentations by adhesive or can be secured in place during the polyethylene pouring operation. Bonding occurs to a fabric that is bonded to the forefoot cushion or the heel cushion.

As an example, approximate dimensions are given for a men's size 9 insole. Length and width of the insole are 28.1 cm (11.063 inches) and 9.7 cm (3.813 inches). The length and width will vary according to the shoe size for which the insole is intended.

The total thickness of the insole can range from 6.8 millimeters near the toe area to 12 millimeters in the arch area. Arch height is about 15 millimeters. The forefoot and heel cushions have a thickness of approximately 4.0 millimeters.

The preferred depth of the heel cup which is measured from the top side of the insole near the center of the heel area vertically to the top of the upraised heel area or heel raised edge is approximately 15-16 millimeters.

Now referring to FIG. 1 which is a perspective view of the bottom (shoe side) of an insole according to the invention. A left insole is illustrated and it can be easily envisioned that a right insole would be a mirror image of the left insole illustrated. Insoles are generally sold and used in pairs, each pair comprising a right and a left insole. Insole (10) of the insole has been divided for discussion into a heel area (10A) adjacent said heel end, an contoured arch support area (10B) adjacent said medial side, a midfoot area (10C) adjacent said contoured arch support area (10B) extending essentially horizontally from said contoured arch support area (10B) to said lateral side, and a forefoot area (10D).

A heel cushioning pad (20) and a forefoot pad (22) are shown secured to indentations in the bottom side of the base. Forefoot pad (22) is secured adjacent said contoured arch support area (10B) and said midfoot area (10C) and extending vertically to said toe end of the insole. Heel cushioning pad (20) is secured in an indentation in the heel area (10A) of the insole. Pattern (24) is visible in this view in midfoot area (10C). A metatarsal indentation (26) is also located in midfoot area (10C). A plurality of curvilinear indentations (28) are positioned from adjacent said midfoot area (10C) to said medial side.

Figure 2:
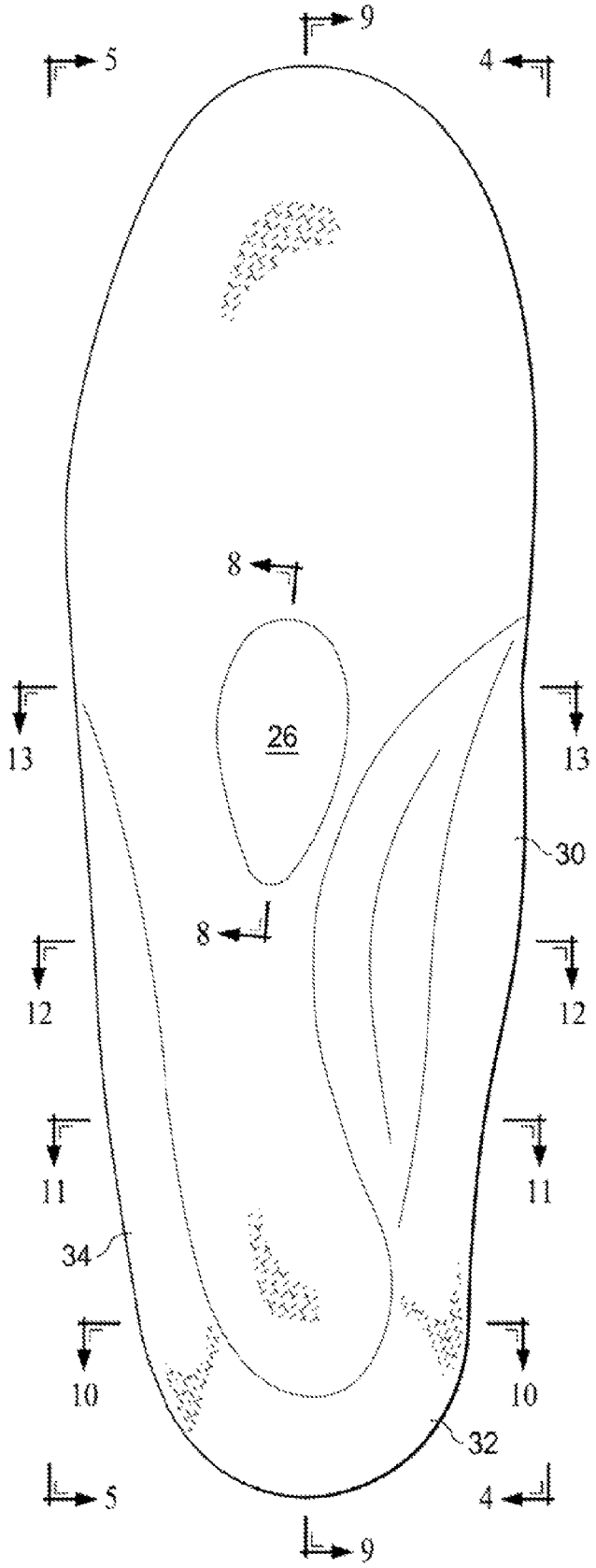
FIG. 2 is a top or foot-side view of a left insole according to the invention.

Now referring to FIG. 2, which illustrates the top (foot side) of an insole according to the invention, metatarsal indentation (26) projects upwardly from the bottom of the insole to the top side. Raised arch support (30) is along the medial side of the insole. The insole is contoured to define upraised heel area (32) and lateral raised edge (34).

Figure 3:
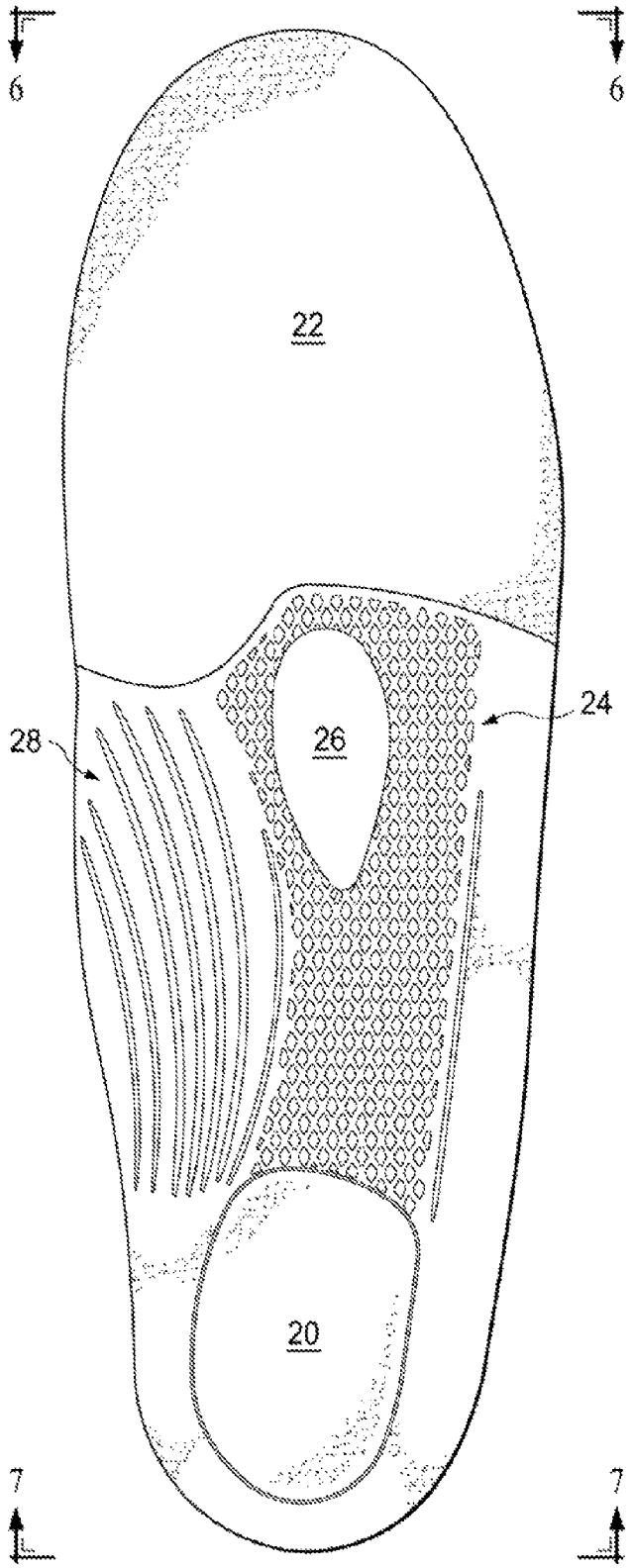
FIG. 3 is a bottom or shoe-side view of a left insole according to the invention.

FIG. 3 illustrates the bottom shoe side of the insole, and metatarsal indentation (26), heel cushioning pad (20), forefoot pad (22), curvilinear indentations (28) and pattern (24) are clearly visible.

Figure 4:
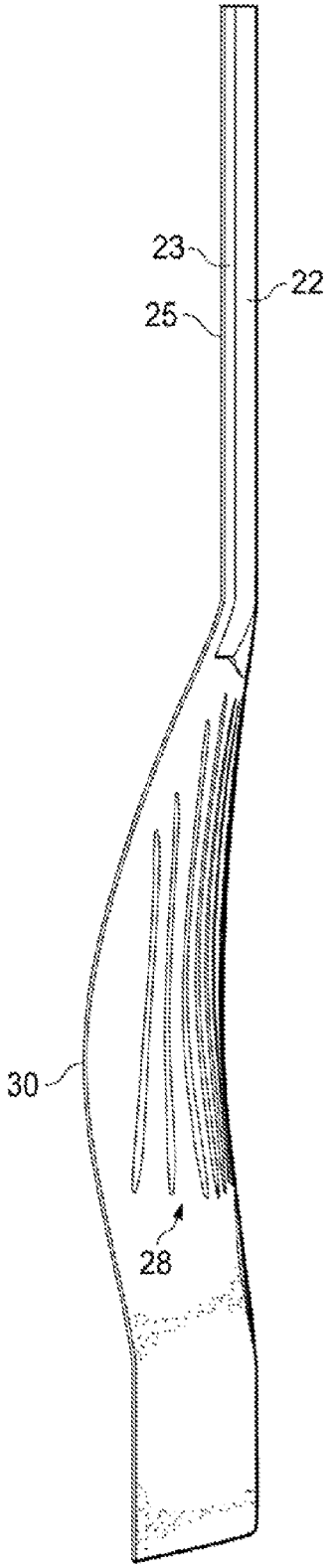
FIG. 4 is a medial side view of a left insole according to the invention, as referenced in FIG. 2 as 4-4.

Referring to FIG. 4 illustrating medial side view, curvilinear indentations (28) and raised arch support (30) are illustrated. Also illustrated are forefoot pad (22), base (23) and top sheet (25). Base (23) extends from the heel region to the toe region. Top sheet (25) is secured to the upper surface of said base and is contiguous therewith.

Raised arch support (30) extends upwardly so it will lie adjacent a user's foot arch during use and provide added comfort.

Figure 5:
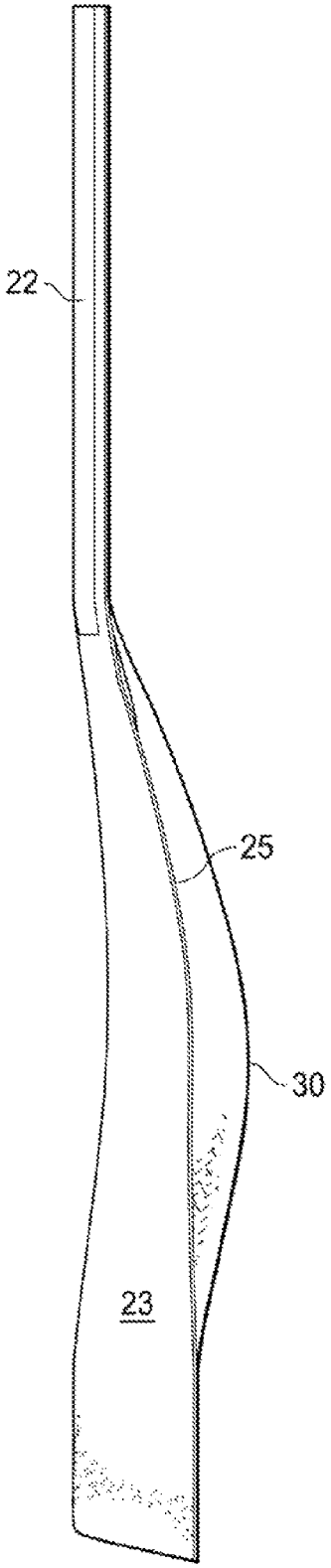
FIG. 5 is a lateral side view of a left insole according to the invention as referenced in FIG. 2 as 5-5.

Now referring to FIG. 5 which shows lateral side view of an insole according to the invention, a portion of base (23) and top sheet (25) on raised arch support (30) are illustrated. Forefoot pad (22) which lies in an indentation in base (23) is also visible.

Figure 6:
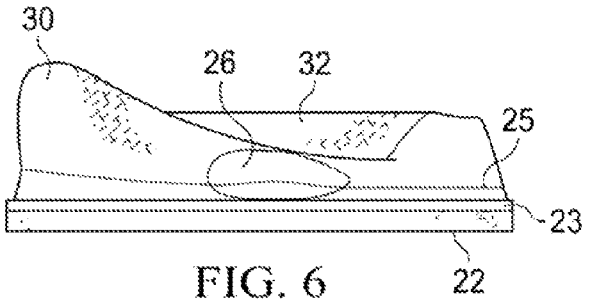
FIG. 6 is an end view of a left insole from the toe area toward the heel area along line 6-6 of FIG. 3.

Now referring to FIG. 6 which is an end view from the toe end looking toward the heel end, upraised heel area (32) is visible at the heel end, raised arch support (30) is seen on the medial side. Forefoot pad (22), base (23) and top sheet (25) are visible.

Upraised heel area (32) is adapted generally to receive the heel area of a user's foot. In this view the contour of upraised heel area (32) is visible. The cup shape allows for extra comfort and security to the heel of the foot.

Figure 7:
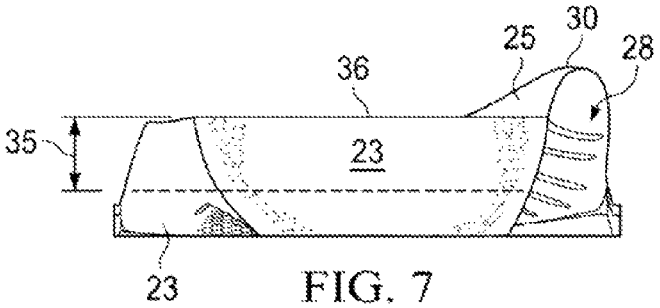
FIG. 7 is an end view of a left insole from the heel area area toward the toe area along line 6-6 of FIG. 3.

FIG. 7 is an end view from the heel area looking toward the toe area. From this view, one can see base (23) at upraised heel area (32), curvilinear indentations (28) on the bottom side of the insole, top sheet (25) in the area of raised arch support (30) and on medial top side.

Also shown is a heel cup depth (35) which is measured from the top sheet (25), approximately at the center of the heel area (10A), vertically up to the heel raised edge (36). In a preferred embodiment, heel cup depth (35) is approximately 15-16 millimeters.

FIGS. 8-13 show cross sections of the lines denoted in FIG. 2.

Figure 8:
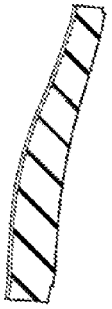
FIG. 8 is a cross-sectional view along line 8-8 of FIG. 2

FIG. 8 illustrates a cross section of metatarsal indentation (26) from line 8-8 of FIG. 2.

Figure 9:
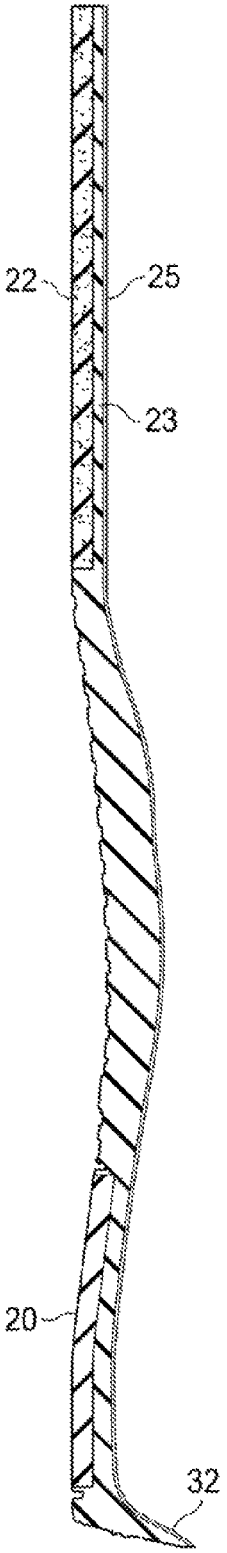
FIG. 9 is a cross sectional view along line 9-9 of FIG. 2.

FIG. 9 is a cross section along line 9-9 of FIG. 2. One can see the cross section of heel cushioning pad (20), forefoot pad (22), base (23) and top sheet (25). Upraised heel area (32) is also illustrated in cross section.

Figure 10:
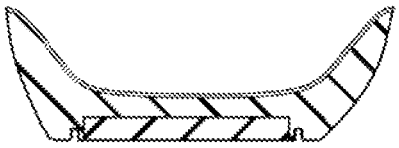
FIG. 10 is a cross sectional view of the heel area along line 10-10 of FIG. 2.
Figure 11:
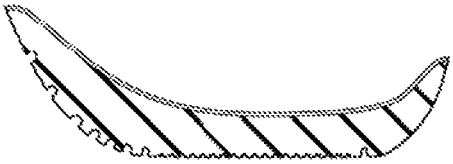
FIG. 11 is a cross sectional view along line 11-11 of FIG. 2.
Figure 12:
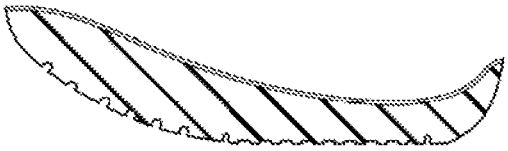
FIG. 12 is a cross-sectional view along line 12-12 of FIG. 2.
Figure 13:
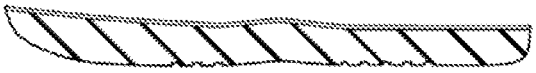
FIG. 13 is a cross sectional view along line 13-13 of FIG. 2.

FIGS. 10-13 show cross-sections of the insole at 10-10, 11-11, 12-12 and 13-13 of FIG. 2 respectively. When compared one to another, the change in shape (both curve and thickness) at different sections of the insole can be seen. The thickness is typically much greater in the arch area of the foot as shown in FIG. 2 and FIG. 12. The cup or dented shape of the upraised heel area (32) is best shown in FIG. 2 and FIG. 10.

We claim:

1. A contoured insole for users having a medium or high foot arch, comprising:

a generally foot-shaped base contoured to define a heel receiving cupped area, a midfoot area, an arch area on a medial side of said base, and a forefoot area, said base having a length extending from a heel end to a toe end, a base top surface and a base bottom surface, said base bottom surface further defining a forefoot pad indentation and a heel pad indentation;

a forefoot pad disposed in said forefoot pad indentation in said forefoot area adjacent said arch area and said midfoot area;

a heel pad disposed in said heel pad indentation;

wherein said base further defines a plurality of longitudinal curvilinear compression indentations extending lengthwise in a longitudinal toe-to-heel direction in said arch area on said base bottom surface on said medial side of said base; and wherein said base further defines a metatarsal support area integral to said base and located in said midfoot area adjacent said arch area;

and wherein said base is formed from a moldable resilient material.

2. The insole of claim 1, wherein said forefoot and heel pads are made of rubber or synthetic rubber.

3. The insole of claim 1, wherein said forefoot and heel pads are made of a neoprene synthetic rubber layer which is a polymer of polychloroprene.

4. The insole of claim 1, wherein said base comprises a lightweight resilient material which is capable of being molded into the desired shape and which provides the desired support and cushioning.

5. The insole of claim 4, wherein said material is a polyurethane foam.

6. The insole of claim 1, further comprising a top sheet having a bottom surface and an upper surface, wherein said bottom surface is secured to said base top surface.

7. The insole of claim 6, wherein said top sheet is a sheet of fabric.

8. The insole of claim 7, wherein said fabric is treated with an antimicrobial substance.

9. A contoured insole for users having a medium or high foot arch, comprising:

a generally foot-shaped base contoured to define a heel receiving cupped area, a midfoot area, an arch area on a medial side of said base, and a forefoot area, said base having a length extending from a heel end to a toe end, a base top surface and a base bottom surface;

wherein said base further defines a plurality of longitudinal curvilinear compression indentations extending lengthwise in a longitudinal heel-to-toe direction in said arch area on said base bottom surface of said medial side of said base;

wherein said base further defines a metatarsal support area integral to said base in said midfoot area adjacent said arch area; and wherein said base is formed from a moldable resilient material that compresses in the arch area more easily than other areas of the insole because of the presence of said longitudinal curvilinear compression indentations extending lengthwise in a heel-to-toe direction in said arch area on the medial side of the base of said insole.

10. The insole of claim 9, wherein said base comprises an indentation to receive a forefoot cushion.

11. The insole of claim 9, wherein said base comprises an indentation to receive a heel cushion.

12. The insole of claim 10, wherein a forefoot cushion is disposed in said forefoot cushion indentation.

13. The insole of claim 11, wherein a heel cushion is disposed in said heel cushion indentation.

14. The insole of claim 9, wherein said base comprises a lightweight resilient material which is capable of being molded into the desired shape and which provides the desired support and cushioning.

15. The insole of claim 14, wherein said material is a polyurethane foam.

16. The insole of claim 9, further comprising a top sheet having a bottom surface and an upper surface, wherein said bottom surface is secured base top surface.

17. The insole of claim 16, wherein said top sheet is a sheet of fabric.

18. The insole of claim 17, wherein said fabric is treated with an antimicrobial substance.

19. A contoured arch support molded into an insole base bottom surface comprising:

a plurality of longitudinal curvilinear compression indentations extending lengthwise in a longitudinal heel-to-toe direction in an arch area on a medial midfoot side of a base bottom surface;

said base and said arch area formed from a moldable resilient material that compresses in the arch area more easily than other areas of the insole because of the presence of said longitudinal curvilinear compression indentations extending lengthwise in a heel to-toe direction and located in said arch area on the medial side of the base bottom surface of said insole.

20. The arch support of claim 19, wherein said plurality of longitudinal curvilinear indentations in said arch area collapse along said lengthwise indentations to fit a user's shoe providing an accommodating fit to said user.

21. The arch support of claim 19, wherein said plurality of longitudinal curvilinear indentations in said arch area collapse along said lengthwise indentations in said arch area of said medial midfoot to minimize voids caused by air entrapment.

22. The arch support of claim 19, wherein said plurality of longitudinal curvilinear indentations in said arch area are positioned on said medial midfoot side of said insole from adjacent a lateral midfoot area to said medial side of said insole.

23. The arch support of claim 19, wherein said plurality of longitudinal curvilinear indentations extend lengthwise in said arch area positioned lengthwise from a border of a forefoot area and said arch area on said medial midfoot side to a border between a heel area and said arch area on said medial midfoot side.

* * * * *